United States Patent [19]

Moran

[11] Patent Number: 5,035,351

[45] Date of Patent: Jul. 30, 1991

[54] METHOD AND APPARATUS FOR MAINTAINING A PRESSURE WITHIN A PRODUCT DISPENSER

[75] Inventor: Michael J. Moran, Markham, Canada

[73] Assignee: CCL Industries Inc., Toronto, Canada

[21] Appl. No.: 470,911

[22] Filed: Jan. 26, 1990

[51] Int. Cl.[5] ..... B65D 83/14; B65D 83/60

[52] U.S. Cl. ..... 222/394; 222/386.5; 222/389

[58] Field of Search ..... 222/386.5, 389, 94, 222/130, 394, 80, 82

[56] References Cited

U.S. PATENT DOCUMENTS

| | | | |
|---|---|---|---|
| 3,178,075 | 4/1965 | Riedl et al. | 222/386.5 |
| 4,360,131 | 11/1982 | Reyner | 222/386.5 |
| 4,376,500 | 3/1983 | Banks | 222/386.5 |

*Primary Examiner*—Andres Kashnikow
*Assistant Examiner*—Lesley D. Morris
*Attorney, Agent, or Firm*—Kenyon & Kenyon

[57] ABSTRACT

An apparatus reestablishes an initial dispensing pressure after each spray down or dispensing of product. A hollow member contains a gas and a liquid reactant. The member has a walled portion with a gas permeable opening. At a pressure equilibrium, where the pressure inside the member equals that outside of the member, substantially no gas or liquid passes in or out of the member through the opening. When product is dispensed the pressure outside of the tube decreases. With this pressure differential the gas in the member forces the liquid reactant out of the tube and into the surrounding environment. A second reactant, disposed outside of the member, mixes with the first reactant to regenerate a pressure outside of the tube, thereby reestablishing an initial dispensing pressure.

29 Claims, 2 Drawing Sheets

METHOD AND APPARATUS FOR MAINTAINING A PRESSURE WITHIN A PRODUCT DISPENSER

BACKGROUND OF THE INVENTION

1. Field of the Invention

This invention is directed to a method and apparatus for maintaining pressure within a product dispenser. In particular, the present invention is directed to a unique method and apparatus which, when pressure within a container is reduced by the dispensing of product, automatically regenerates the pressure within the dispenser so as to re-establish sufficient pressure for dispensing of the product.

2. Background of the Invention

In recent years various efforts have been exerted to supplant conventional aerosol-type dispensers, which used hydrocarbons such as isobutane, or fluorocarbons such as freon, with other propellant means. Thus, a variety of considerations, including cost, wasted product and flammability, have prompted considerable research and development activity aimed at finding alternative means to dispense various flowable material products.

The use of a fluid impervious, expandable bag containing gas generating components, such as that described in U.S. Pat. No. 4,376,500 issued to Banks et al., produces a relatively constant expulsion pressure during use, and overcomes certain problems existent in the prior art. In the Banks et al. patent, as described, the dispensing system expels flowable material product in a uniform spray. However, this known system is complex in that it requires the production of a multi-cavity enfoldment which must have the proper amount of acid disposed in each cavity for regenerating pressure when interacting with the citric acid sodium bicarbonate. In addition, the releasable seals must be properly oriented so that the enfoldment releases the sodium bicarbonate of the proper number of cavities with each occurrence of the dispensing of product. Therefore, it is a difficult and complex task to ensure that the apparatus will regenerate a pressure within the dispenser which corresponds approximately to the starting pressure or initial pressure within the dispenser.

SUMMARY OF THE INVENTION

The present invention provides a unique system for regenerating a pressure within a product dispenser. This system is less complex than those known in the prior art. Further, it provides a high degree of assurance that the pressure regenerated after product is dispensed from the container will be substantially equal to an initial or starting pressure of the product dispenser.

Furthermore, according to the present invention, this pressure regeneration system can be configured so as to permit a nearly unlimited range of motion for the product dispenser while avoiding any reduction in product dispensing pressure.

An apparatus for generating pressure and substantially maintaining that pressure according to a first embodiment of the present invention includes a first enclosure having a first reactant disposed therein. The apparatus also includes a second enclosure that is disposed within the first enclosure and which includes a walled structure having a permeable opening in at least one portion of the walled structure. The apparatus further includes a second reactant disposed in the second enclosure and a first gas that is disposed in the second enclosure where the second reactant is disposed between the first gas and the permeable opening. In the apparatus of this embodiment the size of the permeable opening is such that at a pressure equilibrium (where pressure within the second enclosure approximately equals a pressure in the first enclosure surrounding the second enclosure), the surface tension of the second reactant liquid prevents a flow of the liquid through the permeable opening into the first enclosure region.

According to yet another embodiment of the invention, the pressure generation apparatus can be disposed in a pouch which is insertable within a can or a container. The second enclosure may include a hollow tubular member that is disposed in the bag or pouch.

According to a method of the invention, a pressure is maintained within a product dispensing container by disposing a first reactant in a first enclosure and by disposing a second reactant in a hollow body that includes an aperture. The hollow body is disposed in the first enclosure as well. A start-up pressure is generated in the first enclosure where the start-up pressure is greater than an initial pressure in the hollow body, thereby causing a gas to enter the hollow body through the aperture until a pressure equilibrium has been established. At the equilibrium point, the pressure in the hollow body and in the second enclosure are equal. The first reactant is forced out of the hollow body when a pressure in said first enclosure falls below the equilibrium pressure. A compensating pressure is created in the first enclosure by the reaction of the combination of the second reactant forced from the hollow body with the second reactant which is disposed in the second enclosure.

According to a further embodiment of the present invention, the system for regenerating pressure includes a tubular body which may be made of plastic with a hollow portion and a solid stem portion. A liquid reactant and a gas are disposed in the hollow portion of the tube. One or more holes are provided in the hollow portion of the tube thereby providing a permeable access between the internal region of the tube and the area in which the tube is disposed. The size and number of the apertures and the type of the liquid reactant are selected so that a surface tension of the liquid reactant at the permeable holes will prevent a flow of liquid reactant into the region surrounding the tube when there is pressure equilibrium, i.e., when the pressure inside the tube is equal to the pressure outside of the tube. For example, when the reactant in the tube is a 50% solution of citric acid, an aperture of 0.010 inch will give satisfactory results.

According to yet a further embodiment of the present invention the apparatus may include a tubular hollow body member with little or no stem having a permeable opening that is disposed at a portion above the liquid line of a liquid reactant in an enclosure, such as a pouch.

According to yet another embodiment of the invention, the hollow member may include a device for assuring that, regardless of the orientation of the dispenser, the reactant disposed in the hollow member is always between the permeable opening and the gas which is also enclosed in the hollow member.

DETAILED DESCRIPTION

Figure 1:
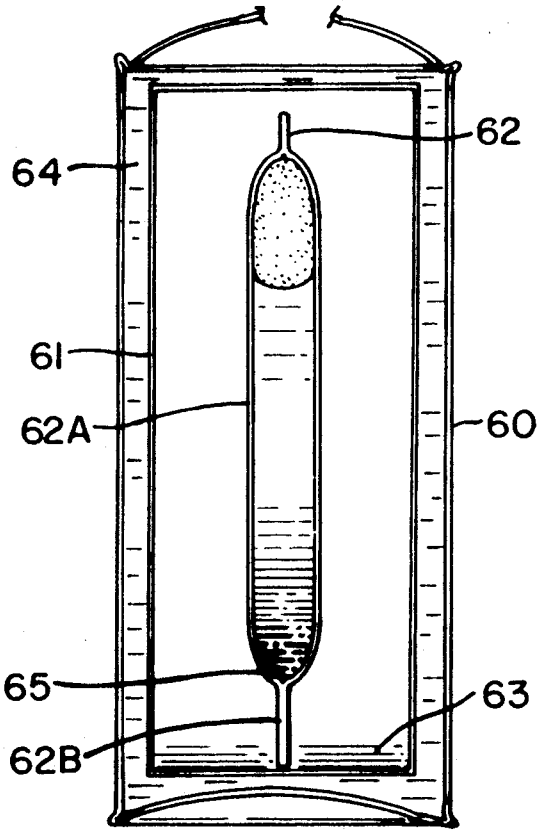
FIG. 1 illustrates a side view of a container configuration including the apparatus of the invention disposed therein.

FIG. 1 illustrates a typical container configuration including the product to be dispensed. An inflatable pouch 61 is inserted in the container or aerosol dispenser 60. A tubular member 62 and a first reactant 63 are disposed in the inflatable pouch 61. The tubular member will be described in greater detail with respect to FIGS. 2-6.

In general, the inflatable pouch 61 is inserted in the container during the assembly process. The pouch is subjected to a preactivation process by which an initial pressure is generated within the pouch 61. The tube member 62 includes a hollow portion 62A and a solid stem portion 62B. A gas and a liquid reactant are disposed in the hollow portion 62A. When the pouch is preactivated to an initial or first pressure, that first pressure generally exceeds the pressure of the gas within the hollow portion 62A. Because of the permeable opening 65 in the tube 62, gas from the inflatable pouch 61 permeates the opening 65 so as to establish a pressure equilibrium between the inside of the hollow tube member 62A and the outside of that member. Product 64 can then be disposed within the container. When a final pressure equilibrium is reached, it corresponds to an initial predetermined dispensing pressure.

When product is dispensed from the container the pressure in the inflatable pouch or bag 61 decreases. At that time, there is no longer an equilibrium between the pressure in the hollow member 62A and the pressure in the pouch 61. The pressure within the tube 62A is higher than that in the pouch 61. Therefore, due to the pressure differential, the gas in the tube overcomes the surface tension of the liquid reactant at the aperture or opening 65 and forces liquid reactant out of the hollow tube 62A into the pouch 61. This liquid reactant mixes with solution 63 to regenerate pressure within the pouch.

As pressure is generated within the pouch, the pouch. approaches the initial dispensing pressure. The gas generation will continue until the pressure inside the can is equal to or greater than the pressure in the tube. Since the reactant mixing, and thus gas generation, is not instantaneous, there may be a certain amount of overshoot. However, by properly selecting the size of the opening and by properly choosing chemical reactants, all of which will be described below, it is possible to make the pressure return to substantially the initial dispensing pressure. Therefore, after each dispensing occurrence, the apparatus of the present invention will cause the regeneration of pressure within the product dispenser so as to return the pressure within the product dispenser to the initial or starting dispensing pressure. The following description will include examples of the apparatus which may be used according to the present invention to regenerate the starting or initial dispensing pressure.

EXAMPLE 1

Figure 2:
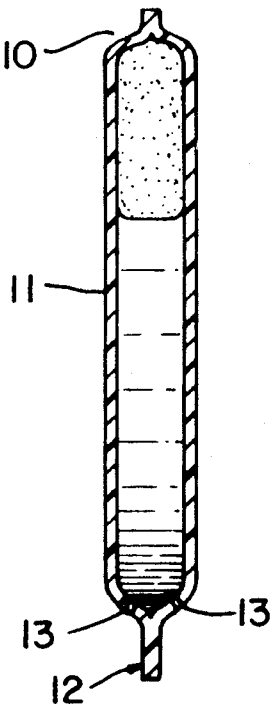
FIG. 2 depicts an enlarged side cross-sectional first embodiment of the tubular member in the apparatus of the invention.

FIG. 2 illustrates a first embodiment of the tubular member 10 in the apparatus of the present invention. This example corresponds to the apparatus disclosed in FIG. 1 in that a tubular member 10 has two portions, a hollow portion 11 and a solid stem portion 12. The hollow portion 11 includes one or more permeable openings or apertures 13. The number of openings is dependent upon the viscosity of the liquid and typically will be between 1 to 4. A liquid is disposed within the hollow portion 11 and a gas is also disposed in that portion of tubular member 10. The liquid reactant and the size of the apertures are selected so that at a pressure equilibrium where the pressure outside of the tube is equal to the pressure inside of the hollow portion of the tube, the liquid does not flow out of the tube regardless of its orientation with respect to the vertical plane. The stem portion 12 is provided so that the apertures 13 remain above a liquid or reactant 63 disposed in the pouch 61 into which the tubular member 10 is inserted. Separating the aperture from the liquid prevents the flow of liquids into the tube from the pouch when such a pressure condition exists and only permits gas to flow into the tube when the pressure outside of the tube exceeds the pressure inside of the tube. The liquid and gas are selected so that the gas (as it permeates the opening into the hollow portion) percolates through the liquid and a pressure equilibrium is approached. The hollow portion of the tube may have an inside diameter of 7 to 12 millimeters. The walls of the tube may be composed of any economical non-reactive material such as, for example, polyethylene or polypropelene. One to four holes may be provided as the apertures or permeable openings, each hole having a diameter of approximately 0.3 millimeters for typical reactants. Such liquid reactant may be composed of a solution of 50% citric acid powder by weight and 50% $H_2O$.

It is preferable to provide an activator or burster which will act as a starter to produce a starting pressure equilibrium in the product dispenser of 50 psi for example. When the product dispenser is activated so as to dispense product, a "spray down" to a reduced pressure, 45 psi for example, in the insertable pouch will typically occur. At that point, the gas inside of the hollow tube member is at a pressure of about 50 psi which exceeds the pressure in the insertable bag, about 45 psi. Therefore, in an effort to reestablish pressure equilibrium, the gas in the tube applies its pressure to the liquid reactant in the tube. The pressure differential overcomes the surface tension of the liquid with respect to the apertures or permeable openings 13. The liquid reactant drips down into the liquid in the inflatable pouch 61. Upon reaction with the liquid, pressure is regenerated in the inflatable pouch and the pressure is typically between 48 and 52 psi when a new equilibrium is established in the pouch. So long as enough liquid reactant is provided in the hollow tube member, this pressure regeneration system will be capable of reestablishing the initial dispensing pressure after every occurrence of dispensing, until all of the product is completely dispensed from the container.

The configuration of FIG. 2 is workable from an orientation of 90′ from the horizontal to approximately 5′ from the horizontal. However, if the container is up-ended so as to turn it upside down during dispensing, then the gas of the tube will be in contact with the permeable opening and the liquid reactant will be disposed at an end of the tube removed from the apertures. In such a case, when the pressure inside the tube exceeds that of outside the tube, as in spray down, the gas inside the tube will seep out of the permeable openings in an attempt to establish pressure equilibrium. No liquid reactant will be forced out of the tube. As a result, the device may not be capable of regenerating the initial or starting dispensing pressure.

EXAMPLE 2

In order to compensate for the possibility that the dispenser will be moved through various orientations during "spray down", the embodiments of FIGS. 3-6 illustrate modifications to the basic configuration which will prevent the gas from coming in direct contact with the permeable openings regardless of the orientation of the container.

Figure 3:
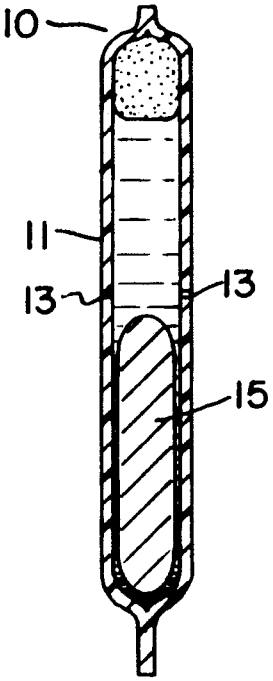
FIG. 3 depicts an enlarged side cross-sectional view of a second embodiment of the tubular member in the apparatus of the invention.

In FIG. 3, the apertures or permeable openings 13 have been moved from near the bottom seal of the tube 10 to the center of the cavity. A non-reacting solid 15, which is more dense than the liquid reactant and which has a volume equal to approximately half of the tube's cavity, is placed in the cavity. Solid 15 has a shape and dimensions which permit it to move freely in the tube under the force of gravity. As the aerosol or product dispenser is tilted through 360′, the solid will move toward the lower end of the tube. This causes the fluid and gas to be oriented so that the fluid or liquid reactant is adjacent to the permeable openings 13. This will cause the tube 11 to maintain pressure in the same manner as if the tube were upright since liquid reactant, rather than the gas, will be forced from the tube during the time period after spray down at which there is a pressure differential.

The configuration of FIG. 3 is further advantageous in that the elongated stem portion 12 of the tubular member of FIG. 1 is no longer necessary. The apertures or permeable openings are disposed at a location above the sealed end of the tube. As a result, the sealed end may be placed directly within the liquid of the inflatable pouch and the apertures will remain above the liquid. As such, only gas will enter into the hollow member through the openings and the liquid reactant (the liquid) of the insertable pouch will not enter the hollow member portion 11.

Figure 4:
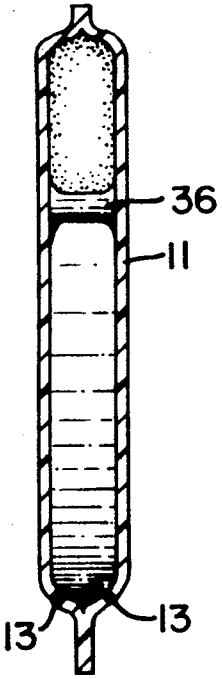
FIG. 4 depicts an enlarged side cross-sectional view of a third embodiment of the tubular apparatus of the present invention.

FIG. 4 provides another means to dispense liquid at any orientation of the container. In this embodiment, an immiscible liquid 36 is added to the top of the liquid reactant. This immiscible liquid must have a density less than the liquid reactant so that it floats on the reactant. It must also have a surface tension such that a large diameter gas bubble, such as that simulated by turning a tube upside down, will not penetrate the liquid, but that small gas bubbles, such as those created by gas entering the tube through the apertures or permeable openings and passing through the liquid reactant, can penetrate the immiscible liquid. The result is that the reactant liquid is always kept at the same end of the tube regardless of the tube's orientation. Gas will then bubble upwardly through the reactant liquid and the immiscible liquid to join the gas bubble at the top of the liquid and establish pressure equilibrium when the pressure in the insertable pouch is larger than that in the hollow tube. The gas and the immiscible liquid will provide pressure to the liquid reactant to force the liquid reactant through the permeable openings when the pressure in the tube exceeds that of the inflatable pouch, regardless of the orientation of the container and the orientation of the tube within the container.

Figure 5:
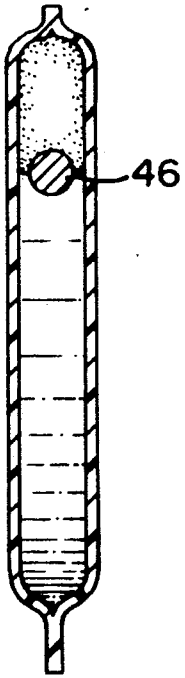
FIG. 5 depicts an enlarged side cross-sectional view of a fourth embodiment.

FIG. 5 illustrates yet another embodiment to allow dispensing regardless of the orientation of the container. In this embodiment, a float 46 is placed on the liquid reactant in the hollow tube. The dimensions of the float are such that the surface tension of the liquid reactant will not permit liquid to flow past the float. However, small gas bubbles from gas that enter into the tube through the permeable openings and percolate the liquid reactant will pass around the float to join the gas disposed above the float. As with FIGS. 3 and 4, the result is that the liquid is always at the same location with respect to the permeable openings or apertures and the gas is prevented from coming into contact with those openings.

Figure 6:
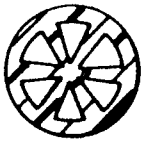
FIG. 6 depicts an enlarged cross section of a hollow member used in conjunction with the fifth embodiment.

FIG. 6 illustrates yet another configuration for modification to the tube which can produce the same effect of allowing freedom of motion for the container. According to this embodiment, the tube is formed with the cross-section shown in FIG. 6 so as to maximize the effect of the surface tension of the liquid. By maximizing the surface tension of the liquid, the cross sectional configuration tends to keep the liquid at one end of the tube. However, the configuration still permits the passage of gas through the liquid reactant and through the tube in to the gas bubble portion. As a result, the gas remains separated from the permeable openings by the liquid reactant regardless of the orientation of the container.

EXAMPLE 3

Figure 7:
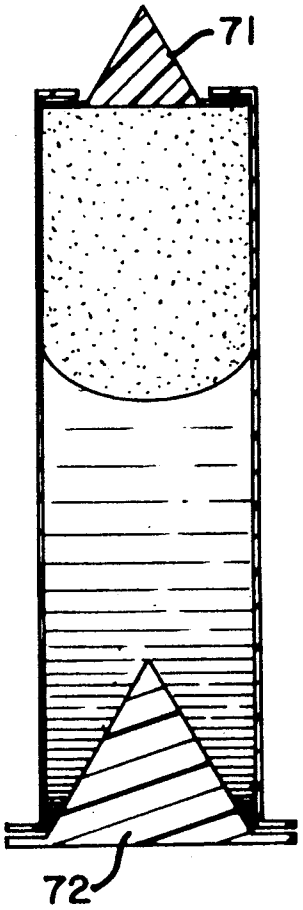
FIG. 7 depicts an enlarged side cross sectional view of a sixth embodiment of the tubular member in the apparatus of the invention

The tube 62 of FIG. 1 may be replaced by another embodiment of the present invention illustrated in FIG. 7. In this embodiment, an injection molded rubber piece with pneumatic valves 71 and 72 at the ends is used in place of the tubes of FIGS. 2 to 6. The pneumatic valve is designed to open when pressure on the outside of the tube exceeds the gas pressure inside the tube. Valve 71 is in contact with the gas contents of the tube and additional gas will be forced into the tube so as to reestablish equilibrium between the pressure inside of the tube and the pressure outside of the tube. When the pressure inside of the tube exceeds the pressure outside of the tube, as when product is dispensed, pneumatic valve 72 will be forced open so that liquid reactant will be forced out of the tube.

Pneumatic valve 71 is forced shut when the internal tube pressure exceeds the pouch pressure and pneumatic valve 72 will be forced shut when the pressure outside of the tube exceeds that inside of the tube. Therefore, the end of the tube at which the liquid is forced out can be placed directly into the liquid reactant of the pouch thereby resulting in a more immediate pressure generation action by the direct mixing of the liquid reactant with the soda. In this configuration, when the pressure outside of the tube is greater than that inside of the tube, liquid will be forced into the tube because such a pressure differential further tightens the pneumatic valve 72 which is disposed within or below the liquid line. In this configuration, 4 cubic centimeters of liquid reactant may be placed within a tube having a 10 mm dia and 115 mm length. The liquid reactant may be a 50% citric acid solution by weight and 50% H2O. An initial dispensing pressure can be established at 50 psi. The tube is then be placed in 200 cubic centimeters of water. Operation of this system maintains a 50 psi dispensing pressure after each dispensing occurrence until all of the product in the container is dispensed.

The present invention provides an unique configuration for regenerating pressure within a product dispenser so that the initial dispensing pressure may be reestablished. The configuration provides a simple and reliable structure for regulating the system pressure.

It should be understood by one of ordinary skill in the art that different solutions of liquid reactants can be utilized in the apparatus of the present invention. Furthermore, hole size can be adjusted based on the surface tension of the liquid reactant which is to be utilized. Furthermore, the size of the gas bubble and the size of the tube itself may be varied depending on its intended use in a product dispensing environment.

It is also possible to use this apparatus in a piston-type dispensing apparatus whereby product is separated from a pressure generation means by a piston which is disposed at a bottom portion of the container rather than by a pouch as illustrated in FIG. 1. The piston, by means of the pressure created between the piston and the container, forces the product from the container. The apparatus of the present invention can be disposed in that region of the container between the piston and the container and isolated from the product. As the pressure in the region defined by the piston and the container decreases as a result of the dispensing of product, the apparatus will be activated in the same manner as in the pouch configuration discussed above so as to generate additional pressure in that region and to reestablish the initial dispensing pressure.

What is claimed is:

1. An apparatus for generating a pressure and substantially maintaining that pressure, comprising:

a first enclosure;

a first reactant disposed in said first enclosure;

a second enclosure, disposed within said first enclosure, comprising a walled structure including a permeable opening in one portion of said walled structure;

a liquid reactant disposed in said second enclosure; and a first gas disposed in said second enclosure in an amount sufficient to overcome the surface tension of said liquid reactant at said permeable opening when the pressure within said second enclosure is not in substantial equilibrium with the pressure in said first enclosure surrounding said second enclosure, said liquid reactant being disposed between said first gas and said permeable opening;

wherein the size of said permeable opening is such that at a pressure equilibrium where a pressure within said second enclosure equals a pressure in said first enclosure surrounding said second enclosure, said liquid reactant does not substantially pass through said permeable opening into said first enclosure region.

2. The apparatus of claim 1 wherein said second enclosure comprises a plurality of permeable openings in said walled structure, each permeable opening having a size such that when a pressure within said second enclosure equals a pressure in said first enclosure surrounding said second enclosure, said second reactant does not substantially pass through said permeable opening into said first enclosure region.

3. The apparatus of claim 1 wherein said second enclosure is oriented in said first enclosure to maintain said permeable opening out of contact with said first reactant.

4. The apparatus of claim 2 wherein said second enclosure is oriented in said first enclosure to maintain said permeable opening out of contact with said first reactant.

5. The apparatus of claim 1 wherein said second enclosure further comprises a stem portion, disposed in said first reactant to maintain said permeable opening out of contact with said first reactant.

6. An apparatus for generating a pressure and substantially maintaining that pressure, comprising:

a first enclosure;

a first reactant disposed in said first enclosure; a second enclosure, disposed within said first enclosure, comprising a walled structure including a permeable opening in one portion of said walled structure;

a second reactant disposed in said second enclosure; and a first gas disposed in said second enclosure, said second reactant being disposed between said first gas and said permeable opening;

wherein the size of said permeable opening is such that at a pressure equilibrium where a pressure within said second enclosure equals a pressure in said first enclosure surrounding said second enclosure, said second reactant does not substantially pass through said permeable opening into said first enclosure region; and a non-reacting solid disposed in said second enclosure and said permeable opening being disposed along a central section of said second enclosure.

7. An apparatus for generating a pressure and substantially maintaining that pressure, comprising:

a first enclosure;

a first reactant disposed in said first enclosure; a second enclosure, disposed within said first enclosure, comprising a walled structure including a permeable opening in one portion of said walled structure;

a second reactant disposed in said second enclosure; and a first gas disposed in said second enclosure, said second reactant being disposed between said first gas and said permeable opening;

wherein the size of said permeable opening is such that at a pressure equilibrium where a pressure within said second enclosure equals a pressure in said first enclosure surrounding said second enclosure, said second reactant does not substantially pass through said permeable opening into said first enclosure region; and an immiscible liquid disposed in said second enclosure between said first gas and said second reactant.

8. The apparatus of claim 7 wherein said immiscible liquid has a density less than said second reactant.

9. An apparatus for generating a pressure and substantially maintaining that pressure, comprising:

a first enclosure;

a first reactant disposed in said first enclosure; a second enclosure, disposed within said first enclosure, comprising a walled structure including a permeable opening in one portion of said walled structure;

a second reactant disposed in said second enclosure; and a first gas disposed in said second enclosure, said second reactant being disposed between said first gas and said permeable opening;

wherein the size of said permeable opening is such that at a pressure equilibrium where a pressure within said second enclosure equals a pressure in said first enclosure surrounding said second enclosure, said second reactant does not substantially pass through said permeable opening into said first enclosure region; and a float disposed in said second enclosure between said first gas and said second reactant.

10. A system for maintaining and dispensing pressure in a container for dispensing product, comprising:

a first enclosure;

a bag disposed in said first enclosure; a first reactant disposed in said bag; a hollow tubular member disposed in said bag, said hollow tubular member including an aperture disposed in a first position of said hollow tubular member;

a gas disposed in said hollow tubular member; and a second reactant disposed in said hollow tubular member between said gas and said aperture wherein said aperture is sized to permit a flow of gas into said hollow tubular member when the pressure in said bag and external to said tubular member exceeds the pressure within said tubular member and permits a flow of said second reactant out of said tubular member when said pressure in said bag, external to said tubular member, is less than the pressure within said tubular member; and means within said hollow tubular member to prevent said gas from directly contacting said aperture to facilitate product dispensing from said container when held at different various orientations.

11. The system of claim 10 wherein said hollow tubular member is oriented in said bag in such a manner as to maintain said aperture out of contact with said first reactant.

12. The system of claim 10 wherein said hollow tubular member comprises a stem portion, disposed in said first reactant and having sufficient length to maintain said aperture out of contact with said first reactant.

13. The system of claim 10 wherein said means to prevent said gas from contacting said aperture comprises a non-reacting solid disposed in said hollow tubular member and wherein said aperture is disposed along a central section of said hollow tubular member.

14. The system of claim 10 wherein said means to prevent said gas from contacting said aperture comprises an immiscible liquid disposed in said hollow tubular member between said gas and said second reactant.

15. The system of claim 14 wherein said immiscible liquid has a density less than said second reactant.

16. The system of claim 10 wherein said means to prevent said gas from contacting said aperture comprises a float disposed in said hollow tubular member between said gas and said second reactant.

17. A method for maintaining a pressure in a product dispensing container comprising the steps of:

disposing a first reactant in a first enclosure;

disposing a liquid reactant and a gas in a hollow body that includes at least two apertures; disposing said hollow body in said first enclosure with said apertures located above said first reactant;

generating a starting pressure in said first enclosure, said starting pressure being greater than an initial pressure in said hollow body thereby causing gas to enter said hollow body through one of said apertures;

utilizing said gas entering said hollow body to overcome the surface tension of said liquid reactant to force said liquid reactant out of said hollow body downwardly through the other of said apertures when a pressure in said first enclosure falls below a pressure in said hollow body; and creating compensating pressure in said first enclosure by the reaction of a combination of said first and liquid reactants; and regulating the amount of liquid reactant to be forced from said hollow body so as to reestablish a pressure in said first enclosure substantially equal to said starting pressure after a dispensing of product from the container.

18. A method for producing a product dispensing container that maintains a substantially constant dispensing pressure, comprising the steps of:

producing a hollow enclosure containing a liquid reactant and a gas, said hollow enclosure comprising a walled member having at least one aperture;

separating said liquid reactant and gas to prevent said gas from directly contacting said aperture at different orientations of said product dispensing container;

inserting said hollow enclosure into a pouch;

disposing a second reactant in said pouch; inserting said pouch in a container;

activating a pressurization mechanism to produce a first pressure in said pouch; and filling said container with product after said first pressure is attained wherein as the pressure inside of said pouch increases the gas pressure inside said hollow enclosure is also increased to establish a pressure equilibrium.

19. A method for maintaining a pressure in a product dispenser during a successive dispensing operation comprising the steps of:

disposing a gas and a liquid reactant in an enclosure having gas permeable and liquid permeable apertures;

establishing an initial equilibrium pressure within said dispenser;

providing sufficient apertures in said enclosure to facilitate that the pressure in said gas permeable enclosure is equal to a pressure in an area immediately surrounding said enclosure;

reducing pressure in said area immediately surrounding said enclosure;

forcing said liquid reactant from said enclosure through said liquid permeable aperture in response to the step of reducing pressure;

reestablishing said initial pressure by mixing said liquid reactant forced from said enclosure, with a second reactant; and regulating the amount of liquid reactant forced through said liquid permeable aperture from said enclosure to produce a second pressure in said dispenser substantially equal to said equilibrium pressure.

20. A product dispenser comprising: a first container;

an inflatable pouch inserted in said first container;

first means, disposed in said inflatable pouch and responsive to an initialization procedure for generating a starting pressure within said inflatable pouch; and second means, disposed in said inflatable pouch, for establishing a pressure substantially equal to said starting pressure after product is dispensed, said second means comprising:

a second container including a gas, an aperture, and a gas permeable wall portion;

a first reactant disposed in said second container;

a second reactant disposed in said inflatable pouch and proximate to said second container wherein said second container includes means, responsive to a depressurization in said inflatable pouch, for forcing said first reactant out of said second container via said aperture and into said inflatable pouch to mix with said second reactant to repressurize said inflatable pouch; and means disposed within said second container to prevent said gas from directly contacting said aperture.

21. A product dispenser comprising: a first container;

an inflatable pouch inserted in said first container;

first means, disposed in said inflatable pouch and responsive to an initialization procedure for generating a starting pressure within said inflatable pouch; and second means, disposed in said inflatable pouch, for establishing a pressure substantially equal to said starting pressure after product is dispensed, said second means comprising:

a second container including a gas permeable wall portion;

a first reactant disposed in said second container; and a second reactant disposed in said inflatable pouch and proximate to said second container wherein said second container includes means, responsive to a depressurization in said inflatable pouch, for forcing said first reactant out of said second container and into said inflatable pouch to mix with said second reactant to repressurize said inflatable pouch; and wherein said second container comprises:

a hollow tubular member having a first and second end;

first means responsive to a pressure imbalance between a first pressure inside said second container and a second pressure surrounding said second container for permitting a flow of gas into said second container when said pressure exceeds said first pressure; and second means responsive to a pressure imbalance between said first and second pressure for permitting a flow of said first reactant out of said second container when said first pressure exceeds said second pressure.

22. The product dispenser of claim 21 wherein said first means is a first pneumatic valve disposed at said first end of said hollow tubular member and said second means is a second pneumatic valve disposed at a said second end of said hollow tubular member.

23. The product dispenser of claim 22 wherein said second end of said hollow tubular member is disposed in contact with said second reactant.

24. A system for dispensing viscous product from a container under pressure which comprises:

a container including a gas generating chamber and a product holding chamber therein;

a first reactant disposed in said gas generating chamber for creating a gas pressure to be exerted on the product to be dispensed;

a pressure regulating mechanism for insertion into said gas generating chamber of said container, said pressure regulating mechanism comprising a hollow elongated member having a first portion and a second portion, and including a second reactant and a gas disposed therein;

gas entry means disposed in said first portion of said hollow elongated member;

exit means disposed in said second portion to allow for discharging said second reactant from said hollow elongated member when a pressure in said hollow elongated member exceeds a pressure outside of said hollow elongated member; and means disposed within said hollow elongated member to prevent said gas from directly contacting said exit means to facilitate product dispensing from said container when held at different orientations.

25. The system of claim 24 wherein said means to prevent said gas from contacting said exit means comprises a non-reacting solid disposed in said hollow elongated member and wherein said exit means is an aperture disposed along a central section of said hollow elongated member.

26. The system of claim 24 wherein said means to prevent said gas from contacting said exit means comprises an immiscible liquid disposed in said hollow elongated member between said gas and said second reactant.

27. The system of claim 26 wherein said immiscible liquid has a density less than said second reactant.

28. The system of claim 24 wherein said means to prevent said gas from contacting said exit means comprises a float disposed in said hollow tubular member between said gas and said second reactant.

29. A system for dispensing viscous product from a container under pressure which comprises:

a container including therein a gas generating chamber and a product holding chamber in communication therewith;

a pressure regulating mechanism for insertion into said gas generating chamber that includes a gas permeable wall and a liquid reactant therein, said pressure regulating mechanism being responsive to an initialization procedure for generating a starting pressure within said gas generating chamber and including means for establishing a pressure substantially equal to said starting pressure after product is dispensed from said container;

a reactant disposed in said gas generating chamber to create a gas pressure to be exerted on the product being dispensed, said reactant being disposed proximate to said pressure regulating mechanism, wherein said pressure regulating mechanism includes means, responsive to a depressurization in said gas generating chamber, for forcing said liquid reactant out of said pressure regulating mechanism and into said gas generating chamber to mix with said reactant therein to repressurize said gas generating chamber; and wherein said pressure regulating mechanism comprises:

a hollow tubular member having a first and a second end;

first means responsive to a pressure imbalance between a first pressure inside said pressure regulating mechanism and a second pressure surrounding said pressure regulating mechanism for permitting a flow of gas into said pressure regulating mechanism when said surrounding pressure exceeds said first pressure; and second means responsive to a pressure imbalance between said first and second pressure for permitting a flow of said liquid reactant out of said pressure regulating mechanism when said first pressure exceeds said second surrounding pressure.

* * * * *